US007646280B2

(12) United States Patent
Ito et al.

(10) Patent No.: US 7,646,280 B2
(45) Date of Patent: Jan. 12, 2010

(54) COMMON MODE CHOKE COIL AND MANUFACTURING METHOD THEREOF

(75) Inventors: Tomokazu Ito, Tokyo (JP); Tomonaga Nishikawa, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/196,464

(22) Filed: Aug. 22, 2008

(65) Prior Publication Data

US 2009/0066462 A1 Mar. 12, 2009

(30) Foreign Application Priority Data

Sep. 7, 2007 (JP) ..... 2007-232244

(51) Int. Cl.
*H01F 5/00* (2006.01)

(52) U.S. Cl. ..... 336/200

(58) Field of Classification Search ..... 336/65, 336/83, 200, 206–208, 223, 232
See application file for complete search history.

(56) References Cited

U.S. PATENT DOCUMENTS

| | | | | |
|---|---|---|---|---|
| 6,601,947 | B1 | 8/2003 | Sato et al. | |
| 7,091,816 | B1 * | 8/2006 | Ito et al. | 336/200 |
| 7,397,334 | B2 * | 7/2008 | Yoshida et al. | 336/200 |
| 2003/0059627 | A1 | 3/2003 | Tsuruta et al. | |
| 2006/0097835 | A1 | 5/2006 | Tomonari et al. | |

FOREIGN PATENT DOCUMENTS

| | | | |
|---|---|---|---|
| JP | 08203737 | | 8/1996 |
| JP | H11-340041 | | 12/1999 |
| JP | 2002-368069 | | 12/2002 |
| JP | 2002359116 | A * | 12/2002 |
| JP | 2003-77740 | | 3/2003 |
| JP | 2005129793 | | 5/2005 |
| JP | 2006-140229 | | 6/2006 |
| JP | 2006-147615 | | 6/2006 |
| JP | 2006147615 | | 6/2006 |
| JP | 2007103561 | | 4/2007 |
| JP | 2007-123352 | | 5/2007 |
| JP | 2007214448 | | 8/2007 |
| WO | 00/58205 | | 5/2000 |

OTHER PUBLICATIONS

JP Office Action dated Jul. 21, 2009 in counterpart JP patent application 2007-232244.

* cited by examiner

*Primary Examiner*—Tuyen Nguyen
(74) *Attorney, Agent, or Firm*—Young Law Firm, P.C.

(57) ABSTRACT

A common mode choke coil includes two extraction conductors formed on a resin insulating layer, and a concave portion is formed in the resin insulating layer in an area between a first portion covered with one of the extraction conductors and a second portion covered with the other extraction conductor. An upper resin insulating layer is embedded inside the concave portion. Accordingly, because the resin insulating layer is not flat in the portion where the extraction conductors are formed, a distance between the extraction conductors along the surface of the resin insulating layer increases. Therefore, a current path generated due to ion migration along the surface of the insulating layer is hardly formed, thereby enabling to obtain high withstand voltage, even if the distance between the extraction conductors is short.

7 Claims, 10 Drawing Sheets

COMMON MODE CHOKE COIL AND MANUFACTURING METHOD THEREOF

TECHNICAL FIELD

The present invention relates to a common mode choke coil and manufacturing method thereof, and, more specifically relates to a common mode choke coil with a cut-off frequency with respect to a differential mode signal being increased and manufacturing method thereof.

BACKGROUND OF THE INVENTION

Recently, as a high-speed signal transmission interface, USB 2.0 standard and IEEE 1394 standard has become prevalent.

These interfaces are used in various digital equipment such as personal computers and digital cameras. The USB 2.0 standard and IEEE 1394 standard interfaces adopt a differential signal system in which a pair of data lines is used to transmit a differential signal (differential mode signal), different from a single end transmission system, which has been generally used heretofore.

The differential transmission system has excellent characteristics such that a radiation electromagnetic field generated from the data line is less than that in the single end transmission system and it is hardly affected by exogenous noise. Therefore, it is easy to minimize the amplitude of the signal, and signal transmission can be performed at a higher speed than the single end transmission system by reducing rise time and fall time because of the small amplitude.

FIG. 12 is a circuit diagram of a conventional differential transmission circuit.

The differential transmission circuit shown in FIG. 12 includes a pair of data lines 2 and 4, an output buffer 6 that supplies a differential mode signal to the pair of data lines 2 and 4, and an input buffer 8 that receives the differential mode signal from the pair of data lines 2 and 4. According to such a configuration, an input signal IN to be provided to the output buffer 6 is transmitted to the input buffer 8 via the data lines 2 and 4, and reproduced as an output signal OUT. The differential transmission circuit has such a characteristic that the radiation electromagnetic field generated from the data lines 2 and 4 is less. However, when common noise (common mode noise) is superimposed on the data lines 2 and 4, a relatively large radiation electromagnetic field is generated. In order to reduce the radiation electromagnetic field generated by the common mode noise, as shown in FIG. 12, it is effective to insert a common mode choke coil 10 in the data lines 2 and 4.

The common mode choke coil 10 has such characteristics that an impedance with respect to a differential component (differential mode signal) transmitted on the data lines 2 and 4 is low, and an impedance with respect to an in-phase component (common mode noise) is high. Therefore, by inserting the common mode choke coil 10 in the data lines 2 and 4, the common mode noise transmitted on the pair of data lines 2 and 4 can be intercepted without substantially attenuating the differential mode signal. There has been known a laminated common mode choke coil described in, for example, Japanese Patent Application Laid-open No. H8-203737.

Recently, higher-speed and lower-loss signal transmission characteristics are required for the common mode choke coil. To realize the characteristics, it is effective to widen a conductor width of a spiral conductor constituting the common mode choke coil. However, if the conductor width of the spiral conductor is made wider, a parasitic capacitance between a pair of spiral conductors increases by that much. As the frequency of the signal to be transmitted increases, the parasitic capacitance between the spiral conductors affects largely on signal quality. Therefore, when the frequency of the signal to be transmitted is high, it is essential to reduce the parasitic capacitance between the spiral conductors.

The simplest method for reducing the parasitic capacitance between the spiral conductors is to increase a distance between the spiral conductors and use a resin having a low permittivity as a material of an insulating layer provided between the spiral conductors. However, if the distance between the spiral conductors is simply increased, a height of a chip increases, which contradicts a requirement of low height. Further, when a resin material is used as the material of the insulating layer, a resin insulating layer is formed according to a spin coating method. Therefore, to increase the distance between the spiral conductors, while ensuring sufficient flatness, spin coating needs to be performed between the spiral conductors a plurality of times, to thereby increase the number of steps.

When the distance between the spiral conductors is to be increased, therefore, it is desired to adopt a structure in which extraction conductors are arranged between the spiral conductors, as described in FIG. 14 in Japanese Patent Application Laid-open No. H8-203737. That is, by arranging the extraction conductors, which have been heretofore arranged above and below the spiral conductors, between the spiral conductors, the distance between the spiral conductors can be increased, without increasing the number of insulating layers.

However, if the extraction conductors are arranged between the spiral conductors, the distance between a pair of extraction conductors becomes short and the extraction conductors are adjacent to each other, which causes a decrease of withstand voltage, and short-circuit may occur in some cases. This problem becomes noticeable particularly when the spiral conductor is circular. FIG. 13 is an explanatory schematic plan view, where FIG. 13A indicates a position where extraction electrodes are formed when the spiral conductors are square, and FIGS. 13B and 13C indicate the position where the extraction electrodes are formed when the spiral conductors are circular.

As shown in FIG. 13, a spiral conductor 102 is connected to an extraction conductor 112 via a through hole (not shown) at an inner circumferential end 102*a* thereof. Likewise, a spiral conductor 104 is connected to an extraction conductor 114 via a through hole (not shown) at an inner circumferential end 104*a* thereof. To sufficiently increase the distance between the extraction conductors 112 and 114, the positions of the inner circumferential ends 102*a* and 104*a* of the spiral conductors 102 and 104 need to be apart from each other sufficiently. At this time, as shown in FIG. 13A, when the spiral conductors 102 and 104 are square, a difference in number of turns in an inner circumference of the spiral conductors 102 and 104 becomes ¼ turn, by setting the distance between the inner circumferential ends 102*a* and 104*a* to a distance D1 corresponding to an inner circumference diameter of the spiral conductors 102 and 104.

On the other hand, as shown in FIG. 13B, when the spiral conductors 102 and 104 are circular, if the distance between the inner circumferential ends 102*a* and 104*a* is set to a distance D2 corresponding to the inner circumference diameter of the spiral conductors 102 and 104, the difference in number of turns in the inner circumference of the spiral conductors 102 and 104 becomes ½ turn. That is, the difference in number of turns increases as compared to a case that the spiral conductors 102 and 104 are square.

Thus, when the spiral conductors 102 and 104 are circular, symmetrical property is likely to be broken according to a difference of a plan position between the inner circumferential ends 102*a* and 104*a*. Therefore, when the spiral conductors 102 and 104 are circular, there is a growing need to bring the plan positions of the inner circumferential ends 102*a* and 104*a* close to each other. For example, to set the difference in number of turns in the inner circumference of the spiral conductors 102 and 104 to ¼ the same as in FIG. 13A, as shown in FIG. 13C, the distance between the inner circumferential ends 102*a* and 104*a* needs to be decreased considerably. As a result, a distance D3 between the extraction conductors 112 and 114 decreases inevitably, and hence, a decrease in the withstand voltage as well as short-circuit are likely to occur.

Such a problem is not limited to a case that the extraction conductors are arranged between the spiral conductors, and commonly occurs when a pair of extraction conductors is formed on the same insulating layer.

SUMMARY OF THE INVENTION

The present invention has been achieved to solve the above problems, and therefore an object of the present invention is to provide a common mode choke coil and a manufacturing method thereof, in which a pair of extraction conductors is formed on the same insulating layer, while the withstand voltage therebetween is increased.

The above and other objects of the present invention can be accomplished by a common mode choke coil including first and second terminal electrodes, a plurality of laminated insulating layers including at least first to third insulating layers, a first spiral conductor formed on the first insulating layer, a second spiral conductor formed on the second insulating layer, a first extraction conductor formed on the third insulating layer for connecting an inner circumferential end of the first spiral conductor to the first terminal electrode, and a second extraction conductor formed on the third insulating layer for connecting an inner circumferential end of the second spiral conductor to the second terminal electrode. A concave portion is provided between a first portion of the third insulating layer covered with the first extraction conductor and a second portion of the third insulating layer covered with the second extraction conductor, and the concave portion is embedded with another insulating layer different from the third insulating layer. The "another insulating layer" can be the first or second insulating layer, or a fourth insulating layer different from the first to third insulating layers.

According to the present invention, because the third insulating layer in the portion where the first and second extraction conductors are formed is not flat, a distance between the first and second extraction conductors along the surface of the third insulating layer increases. Therefore, because a current path generated due to ion migration along the surface of the third insulating layer is hardly formed, high withstand voltage can be obtained even if a planar distance between the extraction conductors is short.

In the present invention, it is preferable that the third insulating layer is positioned between the first and second insulating layers. According to this configuration, the distance between the spiral conductors can be increased without increasing the number of insulating layers.

In the present invention, it is preferable that the concave portion is provided in at least a portion where the planar distance between the first and second extraction conductors becomes the shortest. According to this configuration, the withstand voltage can be increased in a portion where the withstand voltage is most insufficient.

In the present invention, it is preferable that the first and second spiral conductors are circular. When the spiral conductors are circular, the extraction conductors tend to be adjacent to each other, and hence, the significance of application of the present invention is large. In the present invention, "circular" is a concept including an approximately perfect circular shape, an elliptical shape, and an overall circular shape with a linear portion.

In the present invention, it is preferable that at least the third insulating layer is made of a photosensitive insulating resin. According to this configuration, the concave portion can be easily formed between the first and second portions. Particularly, when such a structure that an opening is provided in the first to third insulating layers, and a magnetic material is provided inside the opening is adopted, exposure and development steps for forming the opening is required. Therefore, the concave portion can be formed without increasing the steps.

The common mode choke coil according to the present invention preferably further includes a third spiral conductor connected to between the first terminal electrode and the first extraction conductor, and a fourth spiral conductor connected to between the second terminal electrode and the second extraction conductor. According to this configuration, impedance mismatch due to an insertion of a capacitive element in a transmission line can be dissolved. Further, the first and third spiral conductors are serially connected via the first extraction conductor, and the second and fourth spiral conductors are serially connected via the second extraction conductor. Therefore, magnetic coupling between the third spiral conductor and another spiral conductor and magnetic coupling between the fourth spiral conductor and another spiral conductor can be reduced.

A manufacturing method according to the present invention is a manufacturing method of a common mode choke coil including laminated first and second spiral conductors, first and second terminal electrodes, a first extraction conductor for connecting an inner circumferential end of the first spiral conductor to the first terminal electrode, and a second extraction conductor for connecting an inner circumferential end of the second spiral conductor to the second terminal electrode. The manufacturing method includes steps of forming a photosensitive insulating resin, forming an insulating layer having an opening and a concave portion by exposing and developing the photosensitive insulating resin, forming the first and second extraction conductors on the insulating layer so as to be opposite to each other via the concave portion, embedding the concave portion with another insulating layer, and providing a magnetic material in the opening.

According to the present invention, because the concave portion is formed simultaneously with exposure and development for forming the opening, the common mode choke coil with the withstand voltage being increased can be manufactured, without increasing the steps.

As described above, according to the present invention, because the withstand voltage between the pair of extraction conductors can be increased, a highly reliable common mode choke coil can be provided.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

Figure 1:
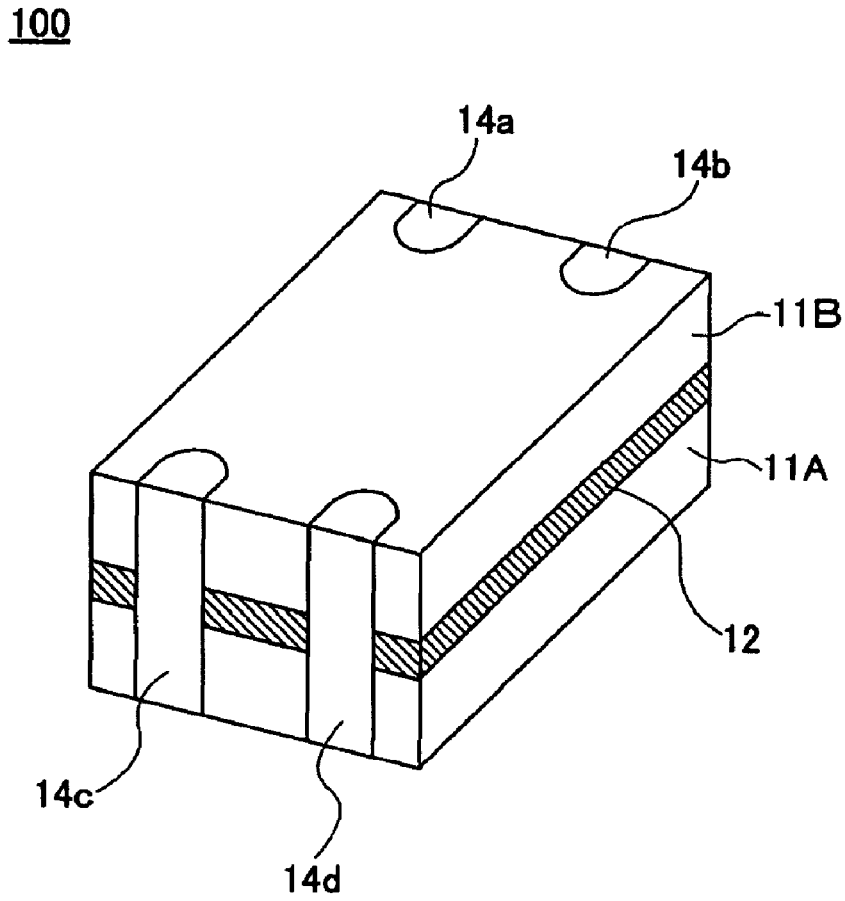
FIG. 1 is a schematic perspective view showing a configuration of a common mode choke coil according to a first embodiment of the present invention.

FIG. 1 is a schematic perspective view showing a configuration of a common mode choke coil 100 according to a first embodiment of the present invention.

As shown in FIG. 1, the common mode choke coil 100 according to the first embodiment is of a thin-film type, and includes first and second magnetic substrates (magnetic layers) 11A and 11B, and a layer structure 12 intervening between the first and second magnetic substrates 11A and 11B. Terminal electrodes 14*a* to 14*d* are formed on an outer circumference of a laminated body formed of the first magnetic substrate 11A, the layer structure 12, and the second magnetic substrate 11B.

The first and second magnetic substrates 11A and 11B physically protect the layer structure 12 and also have a role as a closed magnetic circuit of the common mode choke coil. As a material of the first and second magnetic substrates 11A and 11B, sintered ferrite, composite ferrite (a resin containing powdered ferrite), or the like can be used.

Figure 2:
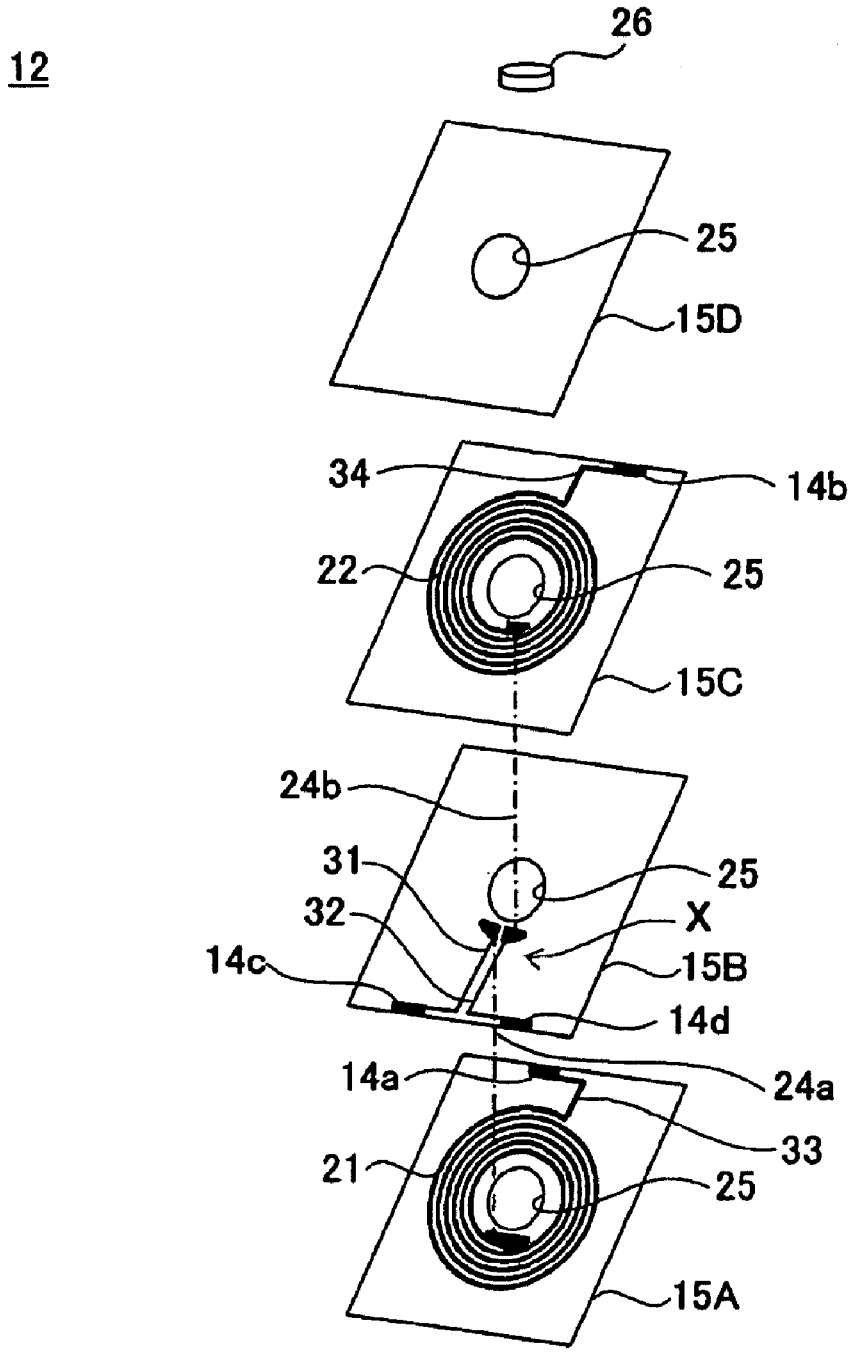
FIG. 2 is a schematic exploded perspective view of the layer structure.

FIG. 2 is a schematic exploded perspective view of the layer structure 12.

As shown in FIG. 2, the layer structure 12 is formed by laminating a plurality of layers according to a thin-film forming technique, and includes first to fourth resin insulating layers 15A to 15D, first and second spiral conductors 21 and 22 that function as an actual common mode choke coil, and first to fourth extraction conductors 31 to 34. The layer structure 12 in the first embodiment has a three-layer structured conductive layer provided between the first resin insulating layer 15A to the fourth resin insulating layer 15D.

The first to fourth resin insulating layers 15A to 15D insulate between respective conductor patters, or between the conductor pattern and the magnetic substrate, and also play a role of ensuring the flatness of a plane on which the conductor pattern is formed. Particularly, the first and fourth resin insulating layers 15A and 15D alleviate surface roughness of the first and second magnetic substrates 11A and 11B, to increase adhesiveness of the conductor pattern. Although not particularly limited, it is preferable to use resin materials having excellent electrical and magnetic insulating properties and good processability such as polyimide resin and epoxy resin, for the resin insulating layers 15A to 15D.

An opening 25 penetrating the first to fourth resin insulating layers 15A to 15D is provided in an inside central region of the first and second spiral conductors 21 and 22. A magnetic body 26 made of magnetic material for forming the closed magnetic circuit between the first magnetic substrate 11A and the second magnetic substrate 11B is provided inside the opening 25. A magnetic material such as composite ferrite can be used for the magnetic body 26.

The first spiral conductor 21 is provided on the second resin insulating layer 15B. The first spiral conductor 21 is made of a metal material such as Cu. An end on the outer circumference side of the first spiral conductor 21 is connected to the terminal electrode 14*a* via the first extraction conductor 31. On the other hand, an end on the inner circumference side of the first spiral conductor 21 is connected to the terminal electrode 14*c* via a contact hole 24*a* penetrating the second resin insulating layer 15B and the third extraction conductor 33.

The second spiral conductor 22 is provided on the third resin insulating layer 15C. The second spiral conductor 22 is also made of a metal material such as Cu, and has the same planar shape as that of the first spiral conductor 21. Because the second spiral conductor 22 is provided at the same position as the first spiral conductor 21 as seen in a plan view, and completely overlapped on the first spiral conductor 21, strong magnetic coupling occurs between the first and second spiral conductors 21 and 22. An end on the outer circumference side of the second spiral conductor 22 is connected to the terminal electrode 14*b* via the second extraction conductor 32. On the other hand, an end on the inner circumference side of the second spiral conductor 22 is connected to the terminal electrode 14*d* via a contact hole 24*b* penetrating the third resin insulating layer 15C and the fourth extraction conductor 34.

As shown in FIG. 2, the first and second extraction conductors 31 and 32 are formed on the same resin insulating layer 15B. Therefore, the first and second extraction conductors 31 and 32 are brought close to each other and the planar distance therebetween becomes very short inevitably, to cause insufficient withstand voltage. Particularly, in an area X close to the contact holes 24*a* and 24*b*, the first and second extraction conductors 31 and 32 cannot be apart from each other, and hence, the withstand voltage becomes most insufficient in this area.

Figure 3:
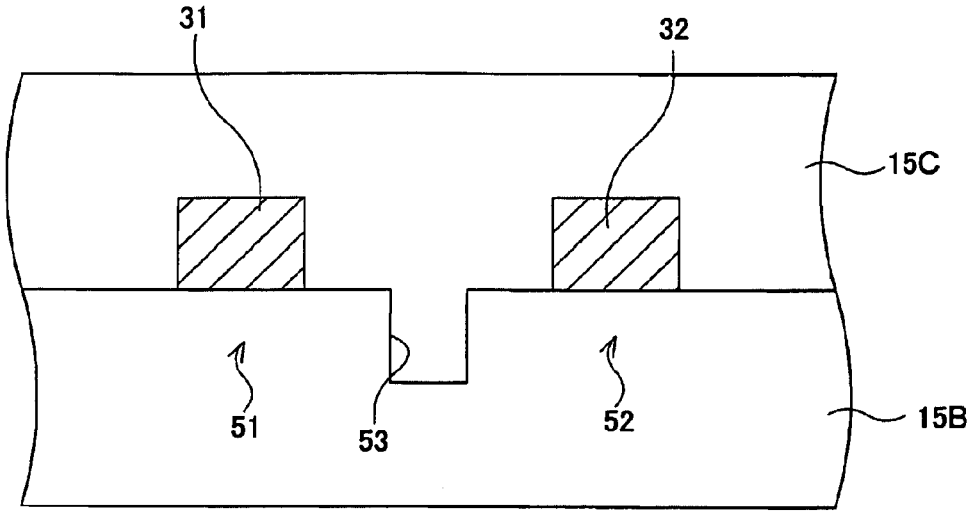
FIG. 3 is a schematic sectional view showing an example of the area X shown in FIG. 2.

FIG. 3 is a schematic sectional view of the area X shown in FIG. 2. In FIG. 3, the spiral conductors 21 and 22 are omitted (also in FIGS. 4 to 8).

As shown in FIG. 3, a concave portion (or a slit) 53 is formed between a first portion 51 of the resin insulating layer 15B covered with the first extraction conductor 31 and a second portion 52 of the resin insulating layer 15B covered with the second extraction conductor 32. The upper resin insulating layer 15C is embedded inside the concave portion 53, and hence, another insulating layer is present between the first portion 51 and the second portion 52.

Thus, the resin insulating layer 15B in the portion where the extraction conductors 31 and 32 are formed is not flat, and has a concavo-convex shape. As a result, because the distance between the extraction conductors 31 and 32 along the surface of the resin insulating layer 15B becomes long, the current path generated due to ion migration along the surface of the resin insulating layer 15B is hardly formed. Accordingly, high withstand voltage can be obtained, though the planar distance is very short.

The concave portion 53 can be formed over the whole area between the extraction conductors 31 and 32; however, it is preferable to provide the concave portion at least in a portion where the planar distance between the extraction conductors 31 and 32 becomes the shortest. According to this structure, the withstand voltage can be increased in the portion where the withstand voltage is most insufficient.

Figure 4:
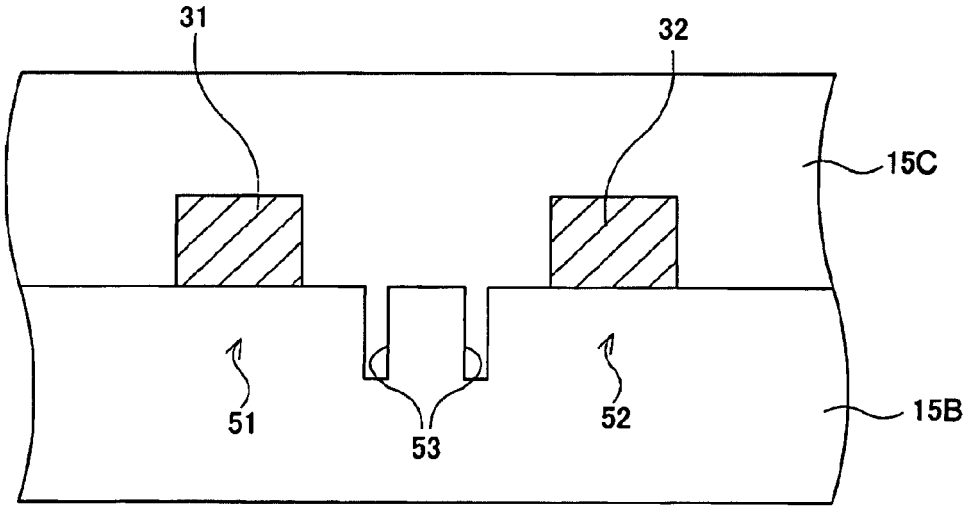
FIG. 4 is a schematic sectional view showing another example of the area X shown in FIG. 2.

In an example shown in FIG. 3, only one concave portion 53 is formed between the first and second portions 51 and 52. However, as shown in FIG. 4, two concave portions 53 can be present therebetween. According to this structure, because the distance between the extraction conductors 31 and 32 along the surface of the resin insulating layer 15B becomes longer, higher withstand voltage can be obtained.

Figure 5:
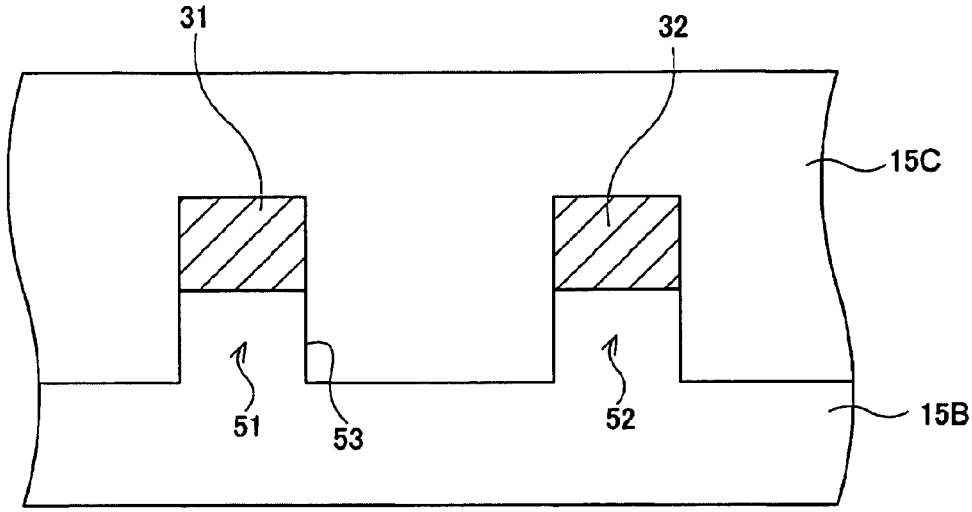
FIG. 5 is a schematic sectional view showing another example of the area X shown in FIG. 2.

Further, in the example shown in FIG. 3, the width of the concave portion 53 is narrower than the distance between the extraction conductors 31 and 32; however, as shown in FIG. 5, the width of the concave portion 53 can be approximately the same as the distance between the extraction conductors 31 and 32. Such a structure can be obtained by etching back the resin insulating layer 15B, using the extraction conductors 31 and 32 as a mask.

Figure 6:
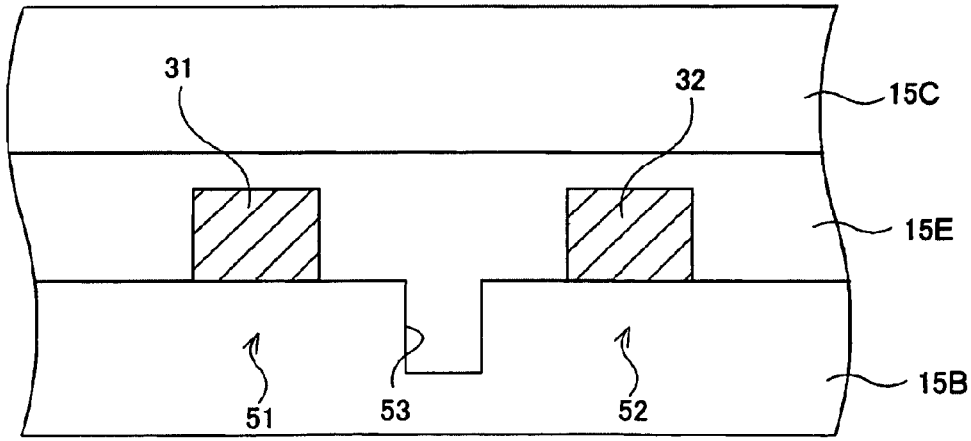
FIG. 6 is a schematic sectional view showing another example of the area X shown in FIG. 2.

In the example shown in FIG. 3, further, the resin insulating layer 15C is embedded inside the concave portion 53; however, as shown in FIG. 6, the structure can be such that another resin insulating layer 15E is put between the resin insulating layers 15B and 15C, and the resin insulating layer 15E is embedded inside the concave portion 53. According to this structure, because the concavo-convex shape due to the concave portion 53 is hardly reflected on the surface of the resin insulating layer 15C, the flatness of the resin insulating layer 15C, on which the spiral conductor 22 is formed, can be increased.

Figure 7:
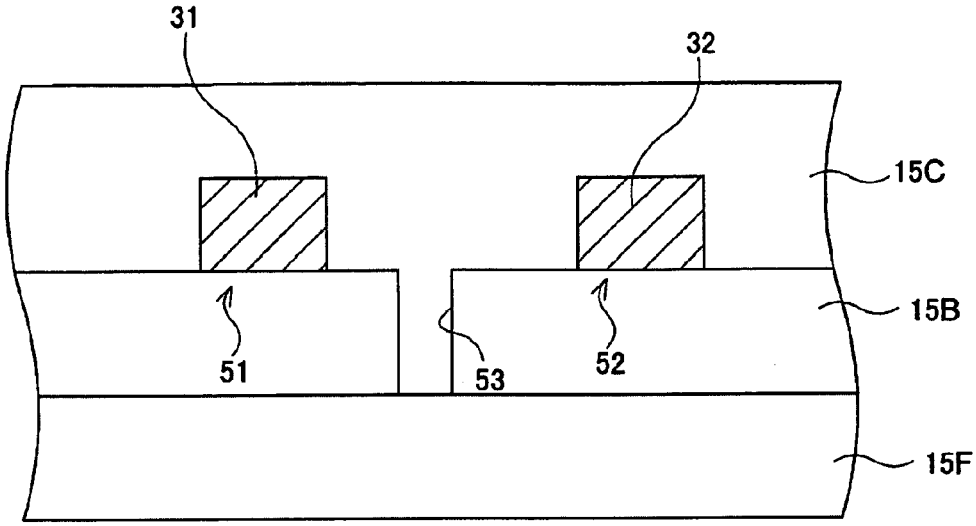
FIG. 7 is a schematic sectional view showing another example of the area X shown in FIG. 2.

Further, in the example shown in FIG. 3, the concave portion 53 does not penetrate the resin insulating layer 15B; however, as shown in FIG. 7, another resin insulating layer 1SF is provided below the resin insulating layer 15B, and the concave portion 53 can penetrate the resin insulating layer 15B. According to this structure, the distance between the extraction conductors 31 and 32 along the surface of the resin insulating layer 15B (and the resin insulating layer 15F) can be further increased, without affecting the spiral conductor 21 formed on the resin insulating layer 15A.

Figure 8:
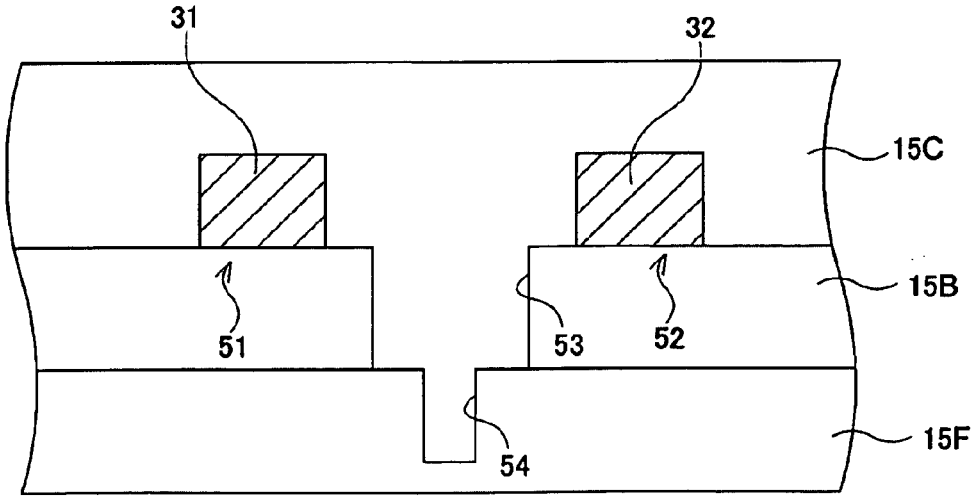
FIG. 8 is a schematic sectional view showing another example of the area X shown in FIG. 2.

In this case, as shown in FIG. 8, a concave portion 54 is also provided in the resin insulating layer 15F, thereby enabling to increase a depth of the concave portions 53 and 54 as a whole. According to this structure, the distance between the extraction conductors 31 and 32 along the surface of the resin insulating layer 15B (and the resin insulating layer 15F) can be further increased, thereby enabling to obtain higher withstand voltage.

Thus, the common mode choke coil 100 according to the present embodiment can obtain high withstand voltage, though the planar distance between the extraction conductors 31 and 32 is very short. Further, a plurality of resin insulating layers 15B and 15C (and the resin insulating layers 15E and 15F (see FIGS. 6 to 8)) is provided between the first and second spiral conductors 21 and 22. Accordingly, the distance between the first and second spiral conductors 21 and 22 is ensured. Therefore, the parasitic capacitance generated between the first and second spiral conductors 21 and 22 is reduced, thereby enabling to increase the cut-off frequency with respect to the differential mode signal.

Although not particularly limited, it is preferable that a total thickness of the resin insulating layers 15B and 15C (and the resin insulating layers 15E and 15F) put between the first and second spiral conductors 21 and 22 be equal to or larger than 10 μm, and more preferably, about 20 μm. Accordingly, because the parasitic capacitance is sufficiently reduced, for example, the cut-off frequency can be equal to or higher than 5 GHz.

The manufacturing method of the common mode choke coil 100 according to the present embodiment is explained next.

Figure 9:
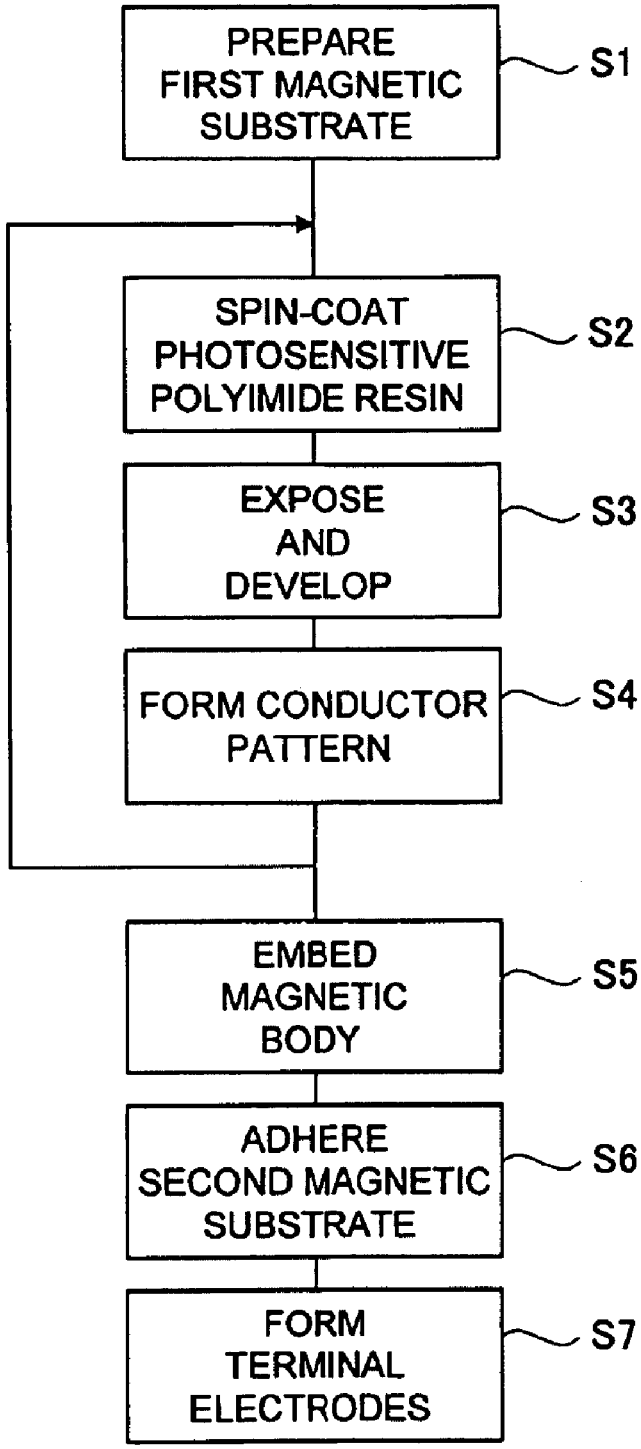
FIG. 9 is a flowchart showing manufacturing steps of the common mode choke coil shown in FIG.1.

FIG. 9 is a flowchart showing manufacturing steps of the common mode choke coil 100 according to the present embodiment.

First, a first magnetic substrate 11A is prepared (step S1). As the first magnetic substrate 11A, it is preferable to use a wafer-shaped substrate capable of forming multiple chips simultaneously. A photosensitive resin (for example, photosensitive polyimide resin) is spin-coated on the magnetic substrate 11A (step S2), which is then exposed and developed (step S3), to thereby form a first resin insulating layer 15A having an opening 25. An underlying conductive layer is formed by an evaporation method or a sputtering method, and plating is performed by using the underlying conductive layer as a feed electrode, to thereby form the first spiral conductor 21 on the first resin insulating layer 15A (step S4). In this case, a resist can be formed on the whole surface of the underlying conductive layer, and after the underlying conductive layer in a predetermined area is exposed by a photolithographic method, plating can be performed. Alternatively, after the underlying conductive layer is patterned according to the photolithographic method, plating can be performed. By repetitively executing these steps S2 to S4, a layer structure 12 shown in FIG. 2 is formed.

In the formation of the second resin insulating layer 15B, the opening 25 and the concave portion 53 can be simultaneously formed by exposure and development of the photosensitive resin. When the depth of the concave portion 53 is set to a depth not penetrating the resin insulating layer 15B (see FIG. 3), an opening width of the mask to be used at the time of exposure can be set sufficiently narrow. If the opening width of the mask is set narrow, an upper part of the photosensitive resin in the area becomes an uncured state and a lower part thereof becomes a cured state. Accordingly, the concave portion 53 having a depth not penetrating the resin insulating layer 15B can be formed.

Further, in the formation of the third resin insulating layer 15C, because the uncured photosensitive resin is embedded inside the concave portion 53, there is hardly any cavity in the concave portion 53.

After the layer structure 12 is formed on the first magnetic substrate 11A, a magnetic body 26 is embedded in the opening 25 (step S5), and the second magnetic substrate 11B is adhered thereto (step S6). After dividing the substrate into individual chips by dicing, terminal electrodes 14*a* to 14*d* are formed (step S7), to thereby complete the common mode choke coil 100 according to the present embodiment.

To obtain high flatness in spin coating of the photosensitive resin, viscosity of a coating solution needs to be adjusted to be sufficiently low. As a result, the thickness of the resin insulating layer that can be formed by one spin coating is limited to about several micrometers. Therefore, in order to set the distance between the first and second spiral conductors 21 and 22 to equal to or larger than 10 μm, for example, about 20 μm, a plurality of resin insulating layers need to be formed between the first and second spiral conductors 21 and 22. That is, spin coating needs to be performed a plurality of times. In such a case, as shown in FIGS. 6 to 8, other resin insulating layers 15E and 15F can be added.

Figure 10:
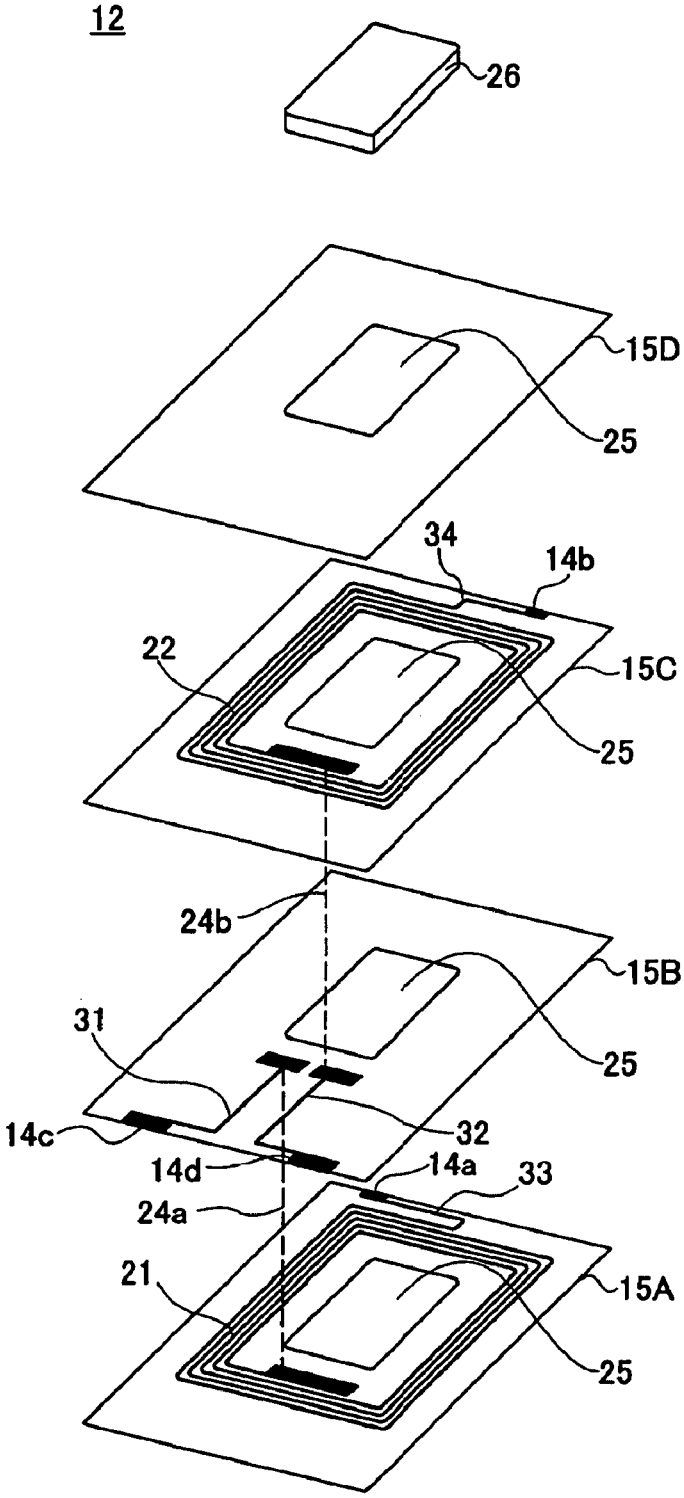
FIG. 10 is a schematic exploded perspective view showing a converted example of the layer structure.
Figure 11:
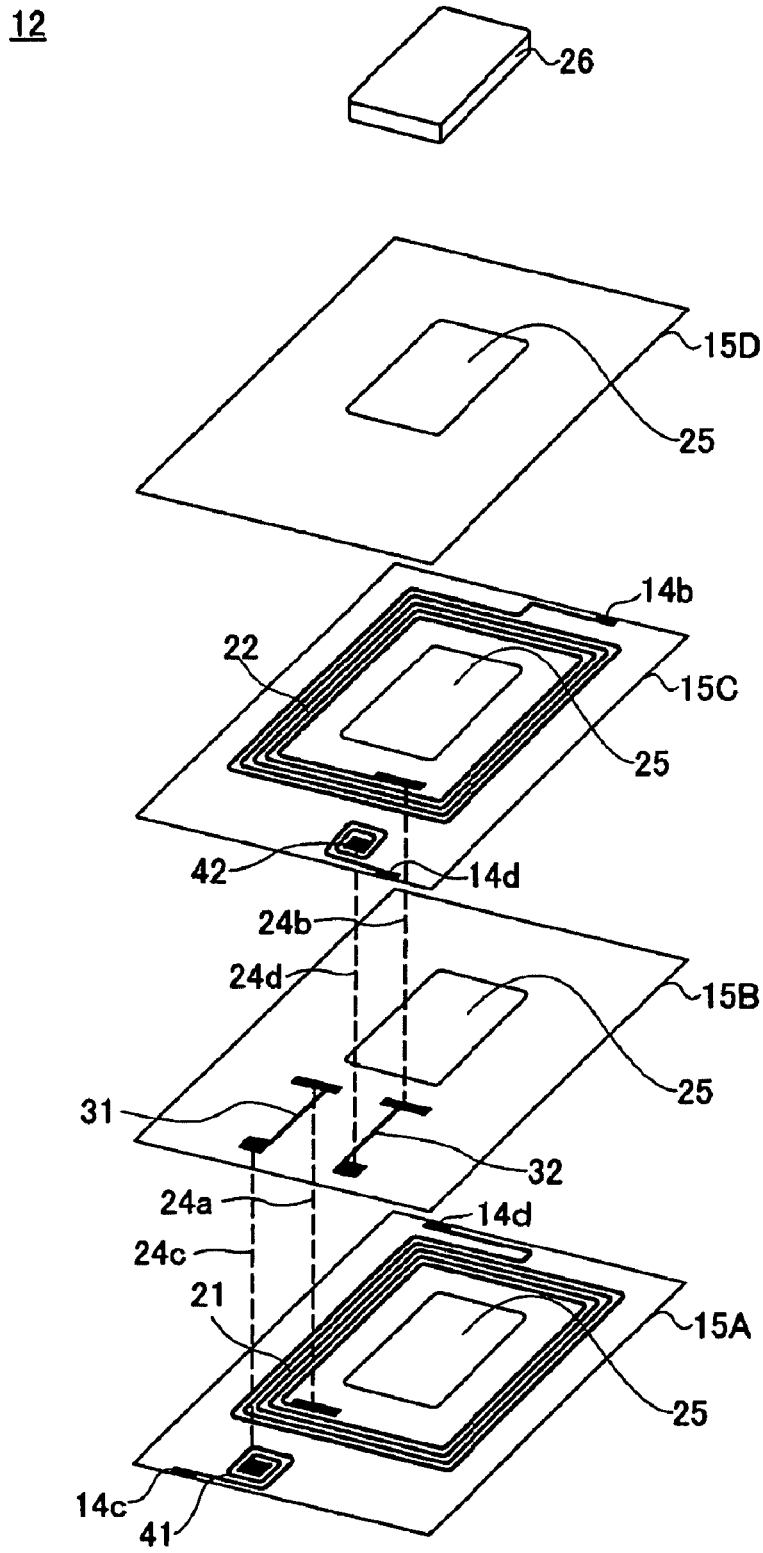
FIG. 11 is a schematic exploded perspective view showing another converted example of the layer structure.
Figure 12:
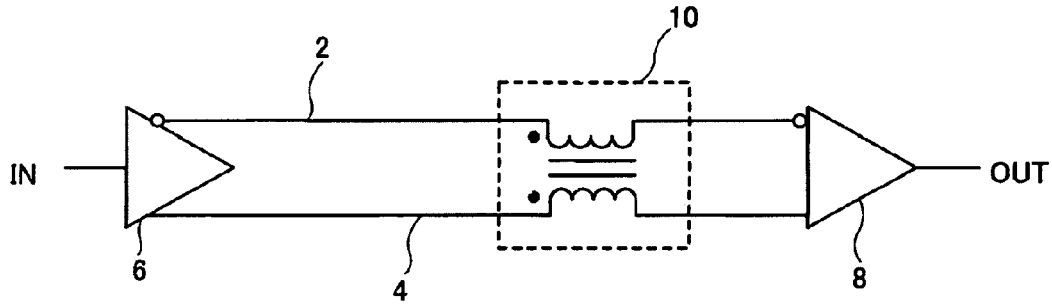
FIG.12 PRIOR ART
FIG. 12 is a circuit diagram of a conventional differential transmission circuit.
Figure 13A:
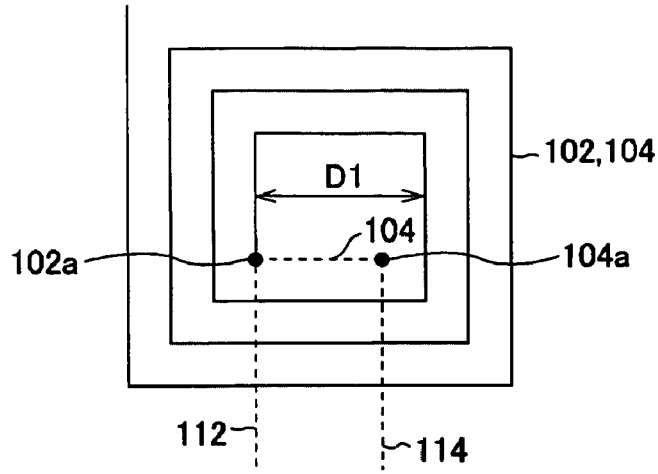
FIG. 13 is an explanatory schematic plan view, where FIG. 13A indicates a position where extraction electrodes are formed when the spiral conductors are square, and FIGS. 13B and 13C indicate the position where the extraction electrodes are formed when the spiral conductors are circular.
Figure 13B:
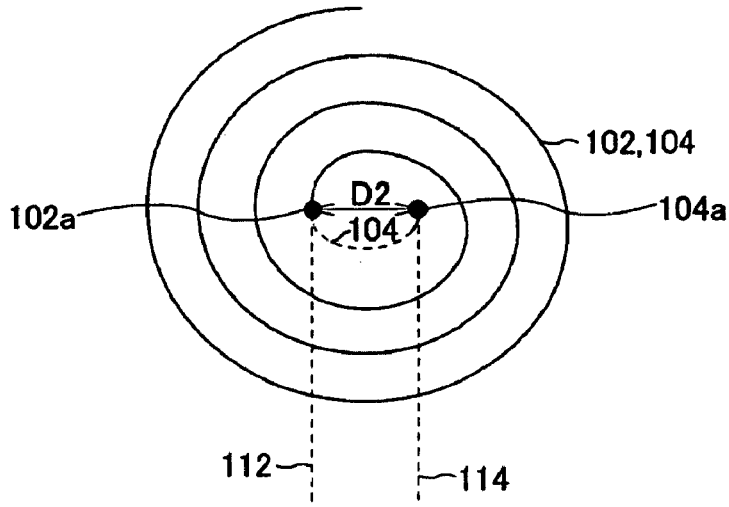
Figure 13C:
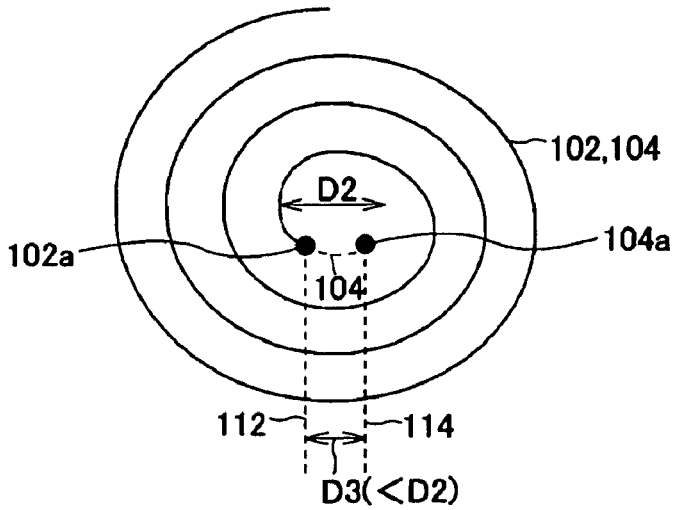

In the present embodiment, the first and second spiral conductors 21 and 22 are circular; however, the present invention is not limited thereto. As shown in FIG. 10, the spiral conductor can be square. Further, as shown in FIG. 11, a third spiral conductor 41 can be added on the resin insulating layer 15A, and a fourth spiral conductor 42 can be added on the resin insulating layer 15C.

The third spiral conductor 41 is not magnetically coupled with another spiral conductor, and an inner circumferential end thereof is connected to the first extraction conductor 31 via a contact hole 24*c* penetrating the second resin insulating layer 15B. That is, the third spiral conductor 41 is serially connected to the first spiral conductor 21 via the first extraction conductor 31. An outer circumferential end of the third spiral conductor 41 is connected to the terminal electrode 14*c*.

The fourth spiral conductor 42 is not magnetically coupled with another spiral conductor as well, and an inner circumferential end thereof is connected to the second extraction conductor 32 via a contact hole 24*d* penetrating the third resin insulating layer 15C. That is, the fourth spiral conductor 42 is serially connected to the second spiral conductor 22 via the second extraction conductor 32. An outer circumferential end of the fourth spiral conductor 42 is connected to the terminal electrode 14*d*.

The characteristic impedance can be adjusted by adding such spiral conductors 41 and 42. That is, in the high-speed interface such as HDMI (High Definition Multimedia Interface), because the structure of the IC itself is vulnerable to ESD (Electrostatic Discharge), a capacitive element such as varistor or Zener diode is often inserted into the transmission line as measures against it. However, if the capacitive element is inserted into the transmission line, there is a problem in that a signal transmitted on the transmission line, particularly, a high-frequency (200 MHz or higher) or a high-speed pulse signal is reflected and attenuated. This is because when the capacitive element is inserted into the transmission line, the characteristic impedance at a position where the capacitive element is inserted in the transmission line decreases due to capacitive components included in the capacitive element, to thereby cause impedance mismatch at the position.

Such impedance mismatch can be dissolved by using the common mode choke coil shown in FIG. 11. Further, the common mode choke coil shown in FIG. 11 can reduce a difference in the inductance between the third and fourth spiral conductors 41 and 42, because these spiral conductors have an approximately line-symmetric relation, thereby reliably enabling to suppress a decrease of the characteristic impedance.

Further, the first and third spiral conductors 21 and 41 are connected to each other at the inner circumferential ends thereof, and likewise, the second and fourth spiral conductors 22 and 42 are connected to each other at the inner circumferential ends thereof. Therefore, to connect these spiral conductors to each other, these spiral conductors need to go through the extraction conductor 31 or 32 formed in another layer, and hence, a wiring distance for connecting these becomes inevitably long. Accordingly, the magnetic coupling between the first and second spiral conductors 21 and 22 decreases largely in this portion. In an example shown in FIG. 11, because the third and fourth spiral conductors 41 and 42 are provided in the portion where the magnetic coupling decreases largely, the magnetic coupling between the first and second spiral conductors 21 and 22 and the third and fourth spiral conductors 41 and 42 can be reliably suppressed.

The present invention is in no way limited to the aforementioned embodiments, but rather various modifications are possible within the scope of the invention as recited in the claims, and naturally these modifications are included within the scope of the invention.

For example, in the present embodiment, the photosensitive resin is spin-coated, and then exposed and developed, to thereby form the resin insulating layer having the opening and the concave portion. However, the method for forming the opening and the concave portion in the resin insulating layer is not limited thereto. For example, after the resin insulating layer is formed by spin coating, a photosensitive resist can be formed, and etching is performed by using this as a mask, so that the opening and the concave portion are formed in the resin insulating layer. Alternatively, after the resin insulating layer is formed by spin coating, laser beams can be irradiated to form the opening and the concave portion in the resin insulating layer. Further, the material of the insulating layer is not limited to a resin material, and other insulating materials can be used.

Further, in the present embodiment, the extraction conductors 31 and 32 are positioned between the pair of spiral conductors 21 and 22; however, the present invention is not limited to this configuration. Therefore, the extraction conductors 31 and 32 can be positioned below the spiral conductor 21, or above the spiral conductor 22. However, if the extraction conductors 31 and 32 are positioned between the spiral conductors 21 and 22, the distance between the spiral conductors 21 and 22 can be increased, while reducing the overall thickness.

In the present embodiment, further, the opening 25 is provided in the resin insulating layers 15A to 15D, and the magnetic body 26 is inserted therein. However, in the present invention, it is not essential to provide these opening and magnetic body.

What is claimed is:

1. A common mode choke coil comprising:

first and second terminal electrodes;

a plurality of laminated insulating layers including at least first to third insulating layers;

a first spiral conductor formed on the first insulating layer;

a second spiral conductor formed on the second insulating layer, a first extraction conductor formed on the third insulating layer for connecting an inner circumferential end of the first spiral conductor to the first terminal electrode; and a second extraction conductor formed on the third insulating layer for connecting an inner circumferential end of the second spiral conductor to the second terminal electrode, wherein the third insulating layer has a concave portion provided between a first portion that is covered with the first extraction conductor and a second portion that is covered with the second extraction conductor, and the concave portion is embedded with another insulating layer different from the third insulating layer.

2. The common mode choke coil as claimed in claim 1, wherein the third insulating layer is positioned between the first and second insulating layers.

3. The common mode choke coil as claimed in claim 1, wherein the concave portion is provided in at least a portion where a planar distance between the first and second extraction conductors becomes shortest.

4. The common mode choke coil as claimed in claim 1, wherein, the first and second spiral conductors are circular.

5. The common mode choke coil as claimed in claim 1, wherein, at least the third insulating layer is made of a photosensitive insulating resin.

6. The common mode choke coil as claimed in claim 1, wherein, the plurality of laminated insulating layers have an opening into which a magnetic material is embedded.

7. The common mode choke coil as claimed in claim 1, further comprising:

a third spiral conductor connected between the first terminal electrode and the first extraction conductor; and a fourth spiral conductor connected between the second terminal electrode and the second extraction conductor.

* * * * *